US009850432B2

(12) United States Patent
Gu et al.

(10) Patent No.: US 9,850,432 B2
(45) Date of Patent: Dec. 26, 2017

(54) METHOD AND REACTOR FOR CRACKING HYDROCARBON AND METHOD FOR COATING THE REACTOR

(75) Inventors: Yanfei Gu, Shanghai (CN); Wenqing Peng, Shanghai (CN); Shizhong Wang, Shanghai (CN); Chuan Lin, Shanghai (CN); Lawrence Bernard Kool, Clifton Park, NY (US); Zhaoping Wu, Shanghai (CN); Qijia Fu, Shanghai (CN); Zhigang Deng, Shanghai (CN)

(73) Assignee: General Electric Company, Schenectady, NY (US)

( * ) Notice: Subject to any disclaimer, the term of this patent is extended or adjusted under 35 U.S.C. 154(b) by 752 days.

(21) Appl. No.: 13/996,738

(22) PCT Filed: Dec. 5, 2011

(86) PCT No.: PCT/US2011/063324
§ 371 (c)(1),
(2), (4) Date: Jun. 21, 2013

(87) PCT Pub. No.: WO2012/087550
PCT Pub. Date: Jun. 28, 2012

(65) Prior Publication Data

US 2013/0267750 A1 Oct. 10, 2013

(30) Foreign Application Priority Data

Dec. 22, 2010 (CN) ..... 2010 1 0613288

(51) Int. Cl.
*C10B 43/14* (2006.01)
*C10G 9/16* (2006.01)

(52) U.S. Cl.
CPC ..... *C10B 43/14* (2013.01); *C10G 9/16* (2013.01); *C10G 2300/1044* (2013.01); *C10G 2300/1059* (2013.01); *C10G 2300/807* (2013.01); *C10G 2400/20* (2013.01)

(58) Field of Classification Search
CPC ..... C10B 43/14
USPC ..... 427/372.2
See application file for complete search history.

(56) References Cited

U.S. PATENT DOCUMENTS 3,718,553 A 2/1973 Stover
4,179,409 A 12/1979 Gladrow et al.
4,208,269 A * 6/1980 Gladrow ..... B01J 23/002 208/120.01
4,418,008 A 11/1983 Schucker et al.
4,454,021 A 6/1984 Watanabe et al.
4,500,364 A 2/1985 Krutenat
4,647,367 A 3/1987 Urban et al.
5,242,574 A 9/1993 Broutin et al.
5,306,411 A * 4/1994 Mazanec ..... B01D 53/326 204/260
5,380,692 A * 1/1995 Nakatsuji ..... B01D 53/9418 502/241
5,591,315 A * 1/1997 Mazanec ..... B01D 53/326 204/295
6,228,253 B1 5/2001 Gandman
6,287,432 B1 9/2001 Mazanec et al.
6,475,647 B1 11/2002 Mendez et al.
6,569,226 B1 5/2003 Dorris et al.
6,585,883 B1 7/2003 Kelermen et al.
6,657,022 B2 12/2003 Williams et al.
7,625,653 B2 12/2009 Kuroha et al.
(Continued)

FOREIGN PATENT DOCUMENTS

EP 2154225 A1 2/2010
JP 59205332 A 11/1984
(Continued)

OTHER PUBLICATIONS

Yang et al., "A mixed proton, oxygen ion, and electron conducting cathode for SOFCS based on oxide proton conductors," Journal of Power Sources, vol. 195, Aug. 12, 2009, pp. 471-474.*
Yang et al., "Enhanced Sulfur and Coking Tolerance of a Mixed Ion Conductor for SOFCs: BaZr0.1Ce0.7Y0.2-xYbxO3-δ", Science, vol. 326, Issue No. 5949, pp. 126-129, Oct. 2, 2009.
Unofficial English Translation of Chinese Office Action issued in connection with corresponding CN Application No. 201010613288.1 dated Jan. 6, 2014.
(Continued)

*Primary Examiner* — William Phillip Fletcher, III
(74) *Attorney, Agent, or Firm* — Wegman, Hessler & Vanderburg

(57) ABSTRACT

A reactor has an inner surface accessible to the hydrocarbon and comprising a sintered product of at least one of cerium oxide, zinc oxide, tin oxide, zirconium oxide, boehmite and silicon dioxide, and a perovskite material of formula $A_aB_bC_cD_dO_{3-\delta}$. $0<a<1.2$, $0\leq b\leq 1.2$, $0.9<a+b\leq 1.2$, $0<c<1.2$, $0\leq d\leq 1.2$, $0.9<c+d\leq 1.2$, $-0.5<\delta<0.5$. A is selected from calcium, strontium, barium, and any combination thereof. B is selected from lithium, sodium, potassium, rubidium, and any combination thereof. C is selected from cerium, zirconium, antimony, praseodymium, titanium, chromium, manganese, ferrum, cobalt, nickel, gallium, tin, terbium and any combination thereof. D is selected from lanthanum, cerium, praseodymium, neodymium, promethium, samarium, europium, gadolinium, terbium, dysprosium, holmium, erbium, thulium, ytterbium, lutetium, scandium, titanium, vanadium, chromium, manganese, ferrum, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, gallium, indium, tin, antimony and any combination thereof.

20 Claims, No Drawings

(56) References Cited

U.S. PATENT DOCUMENTS

| | | | | |
|---|---|---|---|---|
| 2001/0053467 | A1* | 12/2001 | Kaneko | B01J 23/002 429/479 |
| 2002/0122756 | A1 | 9/2002 | Paulson et al. | |
| 2003/0070963 | A1* | 4/2003 | Zimmermann | B01J 12/007 208/106 |
| 2004/0149628 | A1 | 8/2004 | Ou et al. | |
| 2004/0152586 | A1 | 8/2004 | Ou et al. | |
| 2004/0170803 | A1* | 9/2004 | Ichikawa | B01D 46/0001 428/116 |
| 2004/0188323 | A1 | 9/2004 | Tzatzov et al. | |
| 2006/0135838 | A1 | 6/2006 | Bagherzadeh et al. | |
| 2007/0249884 | A1 | 10/2007 | Carrera et al. | |
| 2007/0260101 | A1 | 11/2007 | Carrera et al. | |
| 2008/0169449 | A1 | 7/2008 | Mundschau | |
| 2008/0184915 | A1 | 8/2008 | Tonkovich et al. | |
| 2010/0112408 | A1* | 5/2010 | Yang | C01G 25/006 429/489 |

FOREIGN PATENT DOCUMENTS

| | | | |
|---|---|---|---|
| JP | 04507258 | A | 12/1992 |
| JP | 08319487 | A | 12/1996 |
| WO | WO 93/13037 | A1 | 7/1993 |
| WO | 2004071656 | A1 | 8/2004 |

OTHER PUBLICATIONS

International Search Report and Written Opinion dated Apr. 27, 2012 which has been issued in connection with PCT Application No. US11/63324 which was filed on Dec. 5, 2011.

Lei Yang et. al.: "A Mixed Proton, Oxygen Ion, and Electron Conducting Cathode for SOFCS Based on Oxide Proton Conductors", Journal of Power Sources, vol. 195, Aug. 12, 2009.

Chendong Zuo et. al.: "Ba(Zr0.1Ce0.7Y0.2) 03-d as an Electrolite for Low Temperature Solid Oxide Fuel Cells", Advanced Materials, vol. 18, Dec. 31, 2006.

C.L. Tsai et. al.: "Low Temperature Sintering of Ba(Zr0.8-x CexY0.2) 03-d using Lithium Fluoride Additive", Solid States Ionics, vol. 181, Jun. 28, 2010.

K. Gdula-Kasica et. al.: "Synthesis of Acceptor Doped Ba—Ce—Zr-0 Perovskites", Cryst. Res. Technol., vol. 45, No. 1, Oct. 12, 2010.

Unofficial English Translation of Japanese Office Action issued in connection with corresponding JP Application No. 2013-546181 dated Oct. 13, 2015.

Office Action dated Jan. 24, 2014 in Chinese Patent Appl. No. 201010192512.4 filed May 31, 2010, pp. 1-17.

English Translation of Search Report dated Aug. 27, 2014 by the State Intellectual Property Office, pp. 1-2.

Communication Pursuant to Article 94(3) EPC issued by the European Patent Office dated Jan. 31, 2014 for European Appl. No. 11 167 508.8, pp. 1-6.

Search Report and Written Opinion from corresponding EP Appl. No. 11167508.8 dated Jul. 12, 2012, pp. 1-7.

Urasaki, et al., "Catalytic activities and coking resistance of Ni/pervoskites in steam reforming of methane," vol. 286, No. 1, pp. 23-29 (May 26, 2005).

Woerde, et al., "Mitigate coke formation" Hydrocarbon Processing, Petrochemical Developments, Mar. 2002, pp. 1-6.

Xingyong, et al., "Basic Organic Chemical Industry Production and Process," Chemical Industry Express, pp. 32-41 (2004).

Yang, et al., "Enhanced Sulfur and Coking Tolerance of a Mixed Ion Conductor for SOFC's: BaZr0.1Ce0.7Y0.2-xYbxO3- . . . " Science, vol. 326, pp. 126-129 (Oct. 2, 2009).

Office Action dated Apr. 28, 2013 in Chinese Patent Appl. No. 201010192512.4 filed May 31, 2010, pp. 1-15.

* cited by examiner

METHOD AND REACTOR FOR CRACKING HYDROCARBON AND METHOD FOR COATING THE REACTOR

BACKGROUND

The invention relates generally to methods and reactors for cracking hydrocarbon and methods for coating the reactors. More specifically, the invention relates to methods and reactors for cracking hydrocarbon, in which the build-up of coke deposits are undesirable.

In the petrochemical industry, hydrocarbons such as ethane, propane, butane, naphtha and gas oil are cracked in reactors, in the presence of from about 30 weight percentage (wt %) to about 70 wt % of steam, at temperature of from about 700° C. to 870° C. in order to produce light olefins such as ethylene, propylene and butene. Sometimes, hydrocarbons such as bottoms from atmospheric and vacuum distillation of crude oil are cracked in reactors at a temperature in a range from about 480° C. to about 600° C. in the presence of about 1 wt % to about 2 wt % steam to produce light hydrocarbon fractions and coke.

The reactor is usually a pyrolysis furnace comprising a firebox through which runs an array of tubing. The array of tubing and corresponding fittings may total several hundred meters in length. The array of tubing may comprise straight or serpentine tubes.

During hydrocarbon cracking processes, the build-up of carbonaceous deposits (i.e. coke deposits) usually happens on inner surfaces of reactor components, for instance, inner radiant tube surfaces of furnace equipment. The inner radiant tube surfaces become gradually coated with a layer of coke, which raises the radiant tube metal temperature (TMT) and increases the pressure drop through radiant coils. In addition, coke build-up adversely affects the physical characteristics of the reactor components, such as the radiant tubes, by deteriorating mechanical properties such as stress rupture, thermal fatigue, and ductility due to carburization.

In order to decoke reactor components, the hydrocarbon cracking must be periodically stopped. Typically, the decoking is carried out by combustion of the coke deposits with steam/air at temperatures of up to 1000° C. Such decoking operations are required approximately every 10 to 80 days, depending on the operation mode, types of hydrocarbons and hydrocarbons throughput, and result in production loss since hydrocarbons feeding must be stopped for such decoking operation.

A variety of methods have been considered in order to overcome the disadvantages of coke build-up on reactor components, such as furnace tube inner surfaces. These methods include: metallurgy upgrade to alloys with increased chromium content of the metal substrates used in the furnaces; adding additives such as sulfur, dimethyl sulfide (DMS), dimethyl disulfide (DMDS) or hydrogen sulfide to the feedstock; and increasing steam dilution of feedstock.

While some of the aforementioned methods have general use in the petrochemical industry, it is desirable to provide a new method and reactor that obviates and mitigates the shortcomings of the prior art and successfully reduces or eliminates the build-up of coke deposits.

BRIEF DESCRIPTION

In one aspect, the invention relates to a method for cracking hydrocarbon, comprising: providing steam and hydrocarbon; and feeding steam and hydrocarbon into a reactor having an inner surface accessible to hydrocarbon, the inner surface comprising a sintered product of a perovskite material of formula $A_aB_bC_cD_dO_{3-\delta}$ and an inorganic material, wherein the inorganic material comprises at least one of cerium oxide, zinc oxide, tin oxide, zirconium oxide, boehmite and silicon dioxide; $0<a<1.2$, $0\leq b\leq 1.2$, $0.9<a+b\leq 1.2$, $0<c<1.2$, $0\leq d\leq 1.2$, $0.9<c+d\leq 1.2$, $-0.5<\delta<0.5$; A is selected from calcium (Ca), strontium (Sr), barium (Ba), and any combination thereof; B is selected from lithium (Li), sodium (Na), potassium (K), rubidium (Rb) and any combination thereof; C is selected from cerium (Ce), zirconium (Zr), antimony (Sb), praseodymium (Pr), titanium (Ti), chromium (Cr), manganese (Mn), ferrum (Fe), cobalt (Co), nickel (Ni), gallium (Ga), tin (Sn), terbium (Tb) and any combination thereof; and D is selected from lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu), scandium (Sc), titanium (Ti), vanadium (V), chromium (Cr), manganese (Mn), ferrum (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), gallium (Ga), indium (In), tin (Sn), antimony (Sb) and any combination thereof.

In another aspect, the invention relates to a reactor for cracking hydrocarbon having an inner surface accessible to the hydrocarbon, the inner surface comprising a sintered product of a perovskite material of formula $A_aB_bC_cD_dO_{3-\delta}$ and an inorganic material, wherein the inorganic material comprises at least one of cerium oxide, zinc oxide, tin oxide, zirconium oxide, boehmite and silicon dioxide; $0<a<1.2$, $0\leq b\leq 1.2$, $0.9<a+b\leq 1.2$, $0<c<1.2$, $0\leq d\leq 1.2$, $0.9<c+d\leq 1.2$, $-0.5<\delta<0.5$; A is selected from calcium (Ca), strontium (Sr), barium (Ba), and any combination thereof; B is selected from lithium (Li), sodium (Na), potassium (K), rubidium (Rb), and any combination thereof; C is selected from cerium (Ce), zirconium (Zr), antimony (Sb), praseodymium (Pr), titanium (Ti), chromium (Cr), manganese (Mn), ferrum (Fe), cobalt (Co), nickel (Ni), gallium (Ga), tin (Sn), terbium (Tb) and any combination thereof; and D is selected from lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu), scandium (Sc), titanium (Ti), vanadium (V), chromium (Cr), manganese (Mn), ferrum (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), gallium (Ga), indium (In), tin (Sn), antimony (Sb) and any combination thereof.

In yet another aspect, the invention relates to a method, comprising: providing a slurry comprising a perovskite material of formula $A_aB_bC_cD_dO_{3-\delta}$ and an inorganic material; applying the slurry to a surface of a reactor; and sintering the slurry; wherein the inorganic material comprises at least one of cerium oxide, zinc oxide, tin oxide, zirconium oxide, boehmite and silicon dioxide; $0<a<1.2$, $0\leq b\leq 1.2$, $0.9<a+b\leq 1.2$, $0<c<1.2$, $0\leq d\leq 1.2$, $0.9<c+d\leq 1.2$, $-0.5<\delta<0.5$; A is selected from calcium (Ca), strontium (Sr), barium (Ba), and any combination thereof; B is selected from lithium (Li), sodium (Na), potassium (K), rubidium (Rb), and any combination thereof; C is selected from cerium (Ce), zirconium (Zr), antimony (Sb), praseodymium (Pr), titanium (Ti), chromium (Cr), manganese (Mn), ferrum (Fe), cobalt (Co), nickel (Ni), gallium (Ga), tin (Sn), terbium (Tb) and any combination thereof; and D is selected from lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu), scandium (Sc), titanium (Ti), vanadium (V), chromium (Cr), manganese (Mn), ferrum (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), gallium (Ga), indium (In), tin (Sn), antimony (Sb) and any combination thereof.

DETAILED DESCRIPTION

In one aspect, the invention relates to a method for cracking hydrocarbon, comprising: providing steam and hydrocarbon; and feeding steam and hydrocarbon into a reactor having an inner surface accessible to hydrocarbon, the inner surface comprising a sintered product of a perovskite material of formula $A_aB_bC_cD_dO_{3-\delta}$ and an inorganic material, wherein the inorganic material comprises at least one of cerium oxide, zinc oxide, tin oxide, zirconium oxide, boehmite and silicon dioxide; $0<a<1.2$, $0\leq b\leq 1.2$, $0.9<a+b\leq 1.2$, $0<c<1.2$, $0\leq d\leq 1.2$, $0.9<c+d\leq 1.2$, $-0.5<\delta<0.5$; A is selected from calcium (Ca), strontium (Sr), barium (Ba), and any combination thereof; B is selected from lithium (Li), sodium (Na), potassium (K), rubidium (Rb) and any combination thereof; C is selected from cerium (Ce), zirconium (Zr), antimony (Sb), praseodymium (Pr), titanium (Ti), chromium (Cr), manganese (Mn), ferrum (Fe), cobalt (Co), nickel (Ni), gallium (Ga), tin (Sn), terbium (Tb) and any combination thereof; and D is selected from lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu), scandium (Sc), titanium (Ti), vanadium (V), chromium (Cr), manganese (Mn), ferrum (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), gallium (Ga), indium (In), tin (Sn), antimony (Sb) and any combination thereof.

In some embodiments, A is selected from strontium (Sr) and barium (Ba). C is selected from cerium (Ce), zirconium (Zr), and manganese (Mn). D is selected from cerium (Ce) and yttrium (Y).

In some embodiments, the perovskite material is selected from $SrCeO_3$, $SrZr_{0.3}Ce_{0.7}O_3$, $BaMnO_3$, $BaCeO_3$, $BaZr_{0.3}Ce_{0.7}O_3$, $BaZr_{0.3}Ce_{0.5}Y_{0.2}O_3$, $BaZr_{0.1}Ce_{0.7}Y_{0.2}O_3$, $BaZrO_3$, $BaZr_{0.7}Ce_{0.3}O_3$, $BaCe_{0.5}Zr_{0.5}O_3$, $BaCe_{0.9}Y_{0.1}O_3$, $BaCe_{0.85}Y_{0.15}O_3$, and $BaCe_{0.8}Y_{0.2}O_3$. For example, for $SrCeO_3$, A is Sr, C is Ce, a=1, b=0, c=1, d=0, and $\delta=0$. For $SrZr_{0.3}Ce_{0.7}O_3$, A is Sr, C is Zr, D is Ce, a=1, b=0, c=0.3, d=0.7, and $\delta=0$. For $BaMnO_3$, A is Ba, C is Mn, a=1, b=0, c=1, d=0, and $\delta=0$. For $BaCeO_3$, A is Ba, C is Ce, a=1, b=0, c=1, d=0, and $\delta=0$. For $BaZr_{0.3}Ce_{0.7}O_3$, A is Ba, C is Zr, D is Ce, a=1, b=0, c=0.3, d=0.7, and $\delta=0$. For $BaZr_{0.3}Ce_{0.5}Y_{0.2}O_3$, A is Ba, C is Zr, D is combination of Ce and Y, a=1, b=0, c=0.3, d=0.7, and $\delta=0$.

In some embodiments, the sintered product comprises $BaZr_{0.3}Ce_{0.7}O_3$.

In some embodiments, the perovskite material is $BaZr_{0.1}Ce_{0.7}Y_{0.2}O_3$.

The inorganic material may comprise one material or a combination of multiple materials. In some embodiments, the inorganic material comprises a combination of zirconium oxide and cerium oxide. In some embodiments, the inorganic material comprises a combination of boehmite and cerium oxide.

In some embodiments, the method for cracking hydrocarbon is operated at a temperature in a range from about 700° C. to about 870° C., a weight ratio of steam to hydrocarbon is in a range from about 3:7 to about 7:3, and the hydrocarbon comprises at least one of ethane, heptane, liquid petroleum gas, naphtha, and gas oil.

In some embodiments, the method for cracking hydrocarbon is operated at a temperature in a range from about 480° C. to about 600° C., the hydrocarbon comprises bottoms from atmospheric and vacuum distillation of crude oil and a weight percentage of steam is in a range from about 1 wt % to about 2 wt %.

In some embodiments, the hydrocarbon comprises at least one of ethane, heptane, liquid petroleum gas, naphtha, and gas oil.

In another aspect, the invention relates to a reactor for cracking hydrocarbon having an inner surface accessible to the hydrocarbon, the inner surface comprising a sintered product of a perovskite material of formula $A_aB_bC_cD_dO_{3-\delta}$ and an inorganic material, wherein the inorganic material comprises at least one of cerium oxide, zinc oxide, tin oxide, zirconium oxide, boehmite and silicon dioxide; $0<a<1.2$, $0\leq b\leq 1.2$, $0.9<a+b\leq 1.2$, $0<c<1.2$, $0\leq d\leq 1.2$, $0.9<c+d\leq 1.2$, $-0.5<\delta<0.5$; A is selected from calcium (Ca), strontium (Sr), barium (Ba), and any combination thereof; B is selected from lithium (Li), sodium (Na), potassium (K), rubidium (Rb), and any combination thereof; C is selected from cerium (Ce), zirconium (Zr), antimony (Sb), praseodymium (Pr), titanium (Ti), chromium (Cr), manganese (Mn), ferrum (Fe), cobalt (Co), nickel (Ni), gallium (Ga), tin (Sn), terbium (Tb) and any combination thereof; and D is selected from lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu), scandium (Sc), titanium (Ti), vanadium (V), chromium (Cr), manganese (Mn), ferrum (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), gallium (Ga), indium (In), tin (Sn), antimony (Sb) and any combination thereof.

The perovskite material may or may not chemically react with the inorganic materials before or during sintering. Thus, the sintered product may comprise a combination or a reaction product of the inorganic material and the perovskite material. In some embodiments, the sintered product comprises a combination of $BaZr_{0.3}Ce_{0.7}O_3$ and $CeO_2$. In some embodiments, the sintered product comprises a reaction product of boehmite and $BaZr_{0.3}Ce_{0.7}O_3$. In some embodiments, the sintered product comprises a reaction product of ZnO and $BaZr_{0.3}Ce_{0.7}O_3$. In some embodiments, the sintered product comprises a reaction product of $ZrO_2$ and $BaZr_{0.3}Ce_{0.7}O_3$. In some embodiments, the sintered product comprises a reaction product of Boehmite, $CeO_2$ and $BaZr_{0.3}Ce_{0.7}O_3$. In some embodiments, the sintered product comprises a reaction product of $SiO_2$ and $BaZr_{0.3}Ce_{0.7}O_3$.

The sintered product may be in a coating applied to the inner surface using different methods, for example, air plasma spray, slurry coating, sol-gel coating, and solution coating. In some embodiments, the sintered product is coated using slurry coating method.

The reactor may be any reactor in which hydrocarbon is cracked. In some embodiments, the reactor comprises at least one of a furnace tube, a tube fitting, a reaction vessel, and a radiant tube. In some embodiments, the reactor comprises a firebox having a furnace tube placed inside and being heated to a temperature from about 500° C. to about 1000° C.

In yet another aspect, the invention relates to a method, comprising: providing a slurry comprising a perovskite material of formula $A_aB_bC_cD_dO_{3-\delta}$ and an inorganic material; applying the slurry to a surface of a reactor; and sintering the slurry; wherein the inorganic material comprises at least one of cerium oxide, zinc oxide, tin oxide, zirconium oxide, boehmite and silicon dioxide; $0<a<1.2$, $0\leq b\leq 1.2$, $0.9<a+b\leq 1.2$, $0<c<1.2$, $0\leq d\leq 1.2$, $0.9<c+d\leq 1.2$, $-0.5<\delta<0.5$; A is selected from calcium (Ca), strontium (Sr), barium (Ba), and any combination thereof; B is selected from lithium (Li), sodium (Na), potassium (K), rubidium (Rb), and any combination thereof; C is selected from cerium (Ce), zirconium (Zr), antimony (Sb), praseodymium (Pr), titanium (Ti), chromium (Cr), manganese (Mn), ferrum (Fe), cobalt (Co), nickel (Ni), gallium (Ga), tin (Sn), terbium (Tb) and any combination thereof; and D is selected from lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu), scandium (Sc), titanium (Ti), vanadium (V), chromium (Cr), manganese (Mn), ferrum (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), gallium (Ga), indium (In), tin (Sn), antimony (Sb) and any combination thereof.

The amount of the inorganic material and the perovskite material in the slurry may vary as long as a continuous, strong, and anticoking coating is formed and has good adhesion strength and thermal shock resistivity, depending on the specific inorganic materials and the perovskite material being used and the working condition of the coating. In some embodiments, a weight ratio of the inorganic material to the perovskite material is from about 0.1:99.9 to about 99.9:0.1, or preferably from about 1:9 to about 9:1, or more preferably from about 1.5:100 to about 9:10.

The slurry may further comprise at least one of an organic binder, a wetting agent and a solvent to enhance the slurry wetting ability, tune the slurry viscosity and get good green coating strength. When the at least one of an organic binder, a wetting agent and a solvent is added in the slurry, a total weight percentage of the inorganic materials and the perovskite material in the slurry may be from about 10% to about 90%, or preferably from about 15% to about 70%, or more preferably from about 30% to about 55%.

In some embodiments, the slurry comprises $BaZr_{0.3}Ce_{0.7}O_3$, cerium oxide (10 wt % to 50 wt % of $BaZr_{0.3}Ce_{0.7}O_3$), glycerol, polyvinyl alcohol (PVA) and water.

In some embodiments, the slurry comprises $BaZr_{0.3}Ce_{0.7}O_3$, boehmite (20 wt % of $BaZr_{0.3}Ce_{0.7}O_3$), glycerol, PVA, polyethylene glycol octylphenol ether and water.

In some embodiments, the slurry comprises $BaZr_{0.3}Ce_{0.7}O_3$, zinc oxide (2.6 wt % of $BaZr_{0.3}Ce_{0.7}O_3$), glycerol and PVA.

In some embodiments, the slurry comprises $BaZr_{0.3}Ce_{0.7}O_3$, zirconium oxide (20 wt % to 50 wt % of $BaZr_{0.3}Ce_{0.7}O_3$), glycerol and PVA.

In some embodiments, the slurry comprises $BaZr_{0.3}Ce_{0.7}O_3$, zirconium oxide (5 wt % to 40 wt % of $BaZr_{0.3}Ce_{0.7}O_3$), cerium oxide (50 wt % of $BaZr_{0.3}Ce_{0.7}O_3$), glycerol and PVA.

In some embodiments, the slurry comprises $BaZr_{0.3}Ce_{0.7}O_3$, boehmite (20 wt % of $BaZr_{0.3}Ce_{0.7}O_3$), cerium oxide (50 wt % of $BaZr_{0.3}Ce_{0.7}O_3$), glycerol and PVA.

In some embodiments, the slurry comprises $BaZr_{0.3}Ce_{0.7}O_3$, silicon oxide (1.9 wt % of $BaZr_{0.3}Ce_{0.7}O_3$), glycerol and PVA.

The slurry may be applied to the surface by different techniques, such as at least one of sponging, painting, centrifuging, spraying, filling and draining, and dipping. In some embodiments, the slurry is applied by dipping, i.e., dipping the part to be coated in the slurry. In some embodiments, the slurry is applied by filling and draining, i.e., filling the slurry in the article to be coated and draining out the slurry afterwards by, e.g., gravity.

In some embodiments, the sintering is at about 1000° C.

Definitions

As used herein, the term "reactor" refers to but is not limited to at least one of a furnace tube, a tube fitting, a reaction vessel, and a radiant tube, used in petrochemical processes. The reactor may be a pyrolysis furnace comprising a firebox through which runs an array of tubing. The array of tubing and corresponding fittings may total several hundred meters in length. The array of tubing may comprise straight or serpentine tubes.

As used herein the term "cracking hydrocarbon" refers to but is not limited to processes in which hydrocarbons such as ethane, propane, butane and naphtha are cracked in reactors, in the presence of from about 30 to 70 weight percentage of steam, at temperatures of from about 700° C. to 870° C. in order to produce light olefins such as ethylene and propylene. Sometimes, hydrocarbons such as bottoms from atmospheric and vacuum distillation of crude oil are cracked in reactors at a temperature in a range from about 480° C. to about 600° C. in the presence of about 1 wt % to about 2 wt % steam.

As used herein the term "coke" refers to but is not limited to carbonaceous solid or liquid or particulates or macromolecules forming the carbonaceous solid or liquid, which are derived from coal, petroleum, wood, hydrocarbons and other materials containing carbon and which include, for example, carbon black, tar, and pyrolytic coke existing in hydrocarbon cracking furnace.

As used herein the term "sintering" refers to but is not limited to a method for making objects from powder, by heating the material in a sintering furnace or other heater facility until its particles adhere to each other.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Approximating language, as used herein throughout the specification and claims, may be applied to modify any quantitative representation that could permissibly vary without resulting in a change in the basic function to which it is related. Accordingly, a value modified by a term or terms, such as "about", is not to be limited to the precise value specified. In some instances, the approximating language may correspond to the precision of an instrument for measuring the value. Moreover, the suffix "(s)" as used herein is usually intended to include both the singular and the plural of the term that it modifies, thereby including one or more of that term.

EXAMPLES

The following examples are included to provide additional guidance to those of ordinary skill in the art in practicing the claimed invention. Accordingly, these examples do not limit the invention as defined in the appended claims.

Example 1 $BaZr_{0.3}Ce_{0.7}O_3$ Powder Preparation

The $BaZr_{0.3}Ce_{0.7}O_3$ powder was prepared by solid-state reaction method. Stoichiometric amounts of high-purity barium carbonate, zirconium oxide, and cerium oxide powders (all from sinopharm chemical reagent Co., Ltd. (SCRC), Shanghai, China) were mixed in ethanol and ball-milled for 12 hours. The resultant mixtures were then dried and calcined at 1450° C. in air for 6 hours to form the $BaZr_{0.3}Ce_{0.7}O_3$ powder. The calcined powder was mixed with alcohol and was ball milled for 12 hours. After the alcohol was dried, fine $BaZr_{0.3}Ce_{0.7}O_3$ powder ($d_{50}$=1.5 micron) was prepared.

Example 2 Slurry Preparation $BaZr_{0.3}Ce_{0.7}O_3$ powder prepared in example 1 and different amounts of other components of respective slurries (details of compositions thereof are shown in table 1 below) were respectively added into plastic jars mounted on speed mixer machines. After mixing for 3 minutes with the rotation speed of 2000 revolutions per minute (RPM), respective slurries were prepared.

TABLE 1

| | slurry 1 | slurry 2 | slurry 3 | slurry 4 | slurry 5 | slurry 6 | slurry 7 | slurry 8 | slurry 9 | slurry 10 | slurry 11 | slurry 12 |
|---|---|---|---|---|---|---|---|---|---|---|---|---|
| $BaZr_{0.3}Ce_{0.7}O_3$ powder (g) | 6.63 | 6 | 4.5 | 3 | 3.12 | 2.99 | 3.11 | 3.11 | 3.11 | 3.11 | 3.11 | 2.99 |
| $CeO_2$ sol (g) | 0 | 3 | 6.75 | 7.5 | | 0 | 0 | 0 | 7.77 | 7.77 | 7.77 | 0 |
| Boehmite powder (g) | 0 | 0 | 0 | 0 | 0.62 | 0 | 0 | 0 | 0 | 0 | 0.62 | 0 |
| ZnO sol (g) | 0 | 0 | 0 | 0 | 0 | 0.26 | 0 | 0 | 0 | 0 | 0 | 0 |
| ZrO2 sol (g) | 0 | 0 | 0 | 0 | 0 | 0 | 3.11 | 7.77 | 0.78 | 6.22 | 0 | 0 |
| SiO2 sol (g) | 0 | 0 | 0 | 0 | 0 | 0 | 0 | 0 | 0 | 0 | 0 | 0.21 |
| Glycerol (g) | 1.17 | 1 | 0.75 | 0.5 | 0.79 | 0.51 | 0.58 | 0.58 | 0.58 | 0.58 | 0.58 | 0.51 |
| PVA (10% water solution) (g) | 1.3 | 1.26 | 0.95 | 0.63 | 1.08 | 2.26 | 0.60 | 0.60 | 0.60 | 0.60 | 0.60 | 2.50 |
| $H_2O$ (g) | 3.9 | 5 | 0 | 0 | 25.81 | 0 | 0 | 0 | 0 | 0 | 0 | 0 |
| TritonX100 (μl) | 0 | 0 | 0 | 0 | 10 | 0 | 0 | 0 | 0 | 0 | 0 | 0 |

$CeO_2$ sol (20 wt % in $H_2O$, Alfa Aesar #12730), $ZrO_2$ sol (20 wt % in $H_2O$, Alfa Aesar #12732) were obtained from Alfa Aesar Company, Ward Hill, Mass., USA. Boehmite powder was obtained from Tianjin Chemist Scientific Ltd., Tianjin, China. ZnO sol (30 wt % dispersion in isopropanol) was obtained from Hangzhou Veking Co. Ltd., Hangzhou, China. $SiO_2$ sol (40 wt % dispersion in water, Nalco. #2327) was obtained from Nalco Chemical Co., Chicago, Ill., USA.

Percentages of $CeO_2$ with respect to $BaZr_{0.3}Ce_{0.7}O_3$ in slurries 1-4 were 0 wt %, 10 wt %, 30 wt % and 50 wt %, respectively. Percentage of boehmite powder with respect to $BaZr_{0.3}Ce_{0.7}O_3$ in slurry 5 was 20 wt %. Percentage of ZnO with respect to $BaZr_{0.3}Ce_{0.7}O_3$ in slurry 6 was 2.6 wt %. Percentage of $ZrO_2$ with respect to $BaZr_{0.3}Ce_{0.7}O_3$ in slurries 7 and 8 were 20 wt % and 50 wt %. In slurries 9 and 10, $CeO_2$ were 50 wt % of $BaZr_{0.3}Ce_{0.7}O_3$ and $ZrO_2$ were 5 wt % or 40 wt % of $BaZr_{0.3}Ce_{0.7}O_3$ powder. In slurry 11, $CeO_2$ was 50 wt % of $BaZr_{0.3}Ce_{0.7}O_3$ and Boehmite was 20 wt % of $BaZr_{0.3}Ce_{0.7}O_3$ powder. In slurry 12, $SiO_2$ was 1.9 wt % of $BaZr_{0.3}Ce_{0.7}O_3$ powder.

Example 3 Coating the Slurries on Coupons

A plurality of coupons made from alloy 310S each with the dimension of 10×30×1 $mm^3$ were used as the substrates. Before coating, the substrates were cleaned carefully as follows: ultrasonic agitation in acetone and ethanol for 30 minutes respectively to remove organic contaminants, ultrasonic agitation in HCl (3.3 wt %) aqueous solution for 30 minutes to etch the substrate surface, ultrasonically rinsing in deionized water, and dried using compressed air.

Cleaned coupons were dipped into the slurries prepared in EXAMPLE 2 and then was lifted out with the speed of 70 mm/min. The coated coupons were dried at the room temperature for 12 hours and were then put into a furnace for sintering at 1000° C. for 3 hours in argon atmosphere before being cooled to the room temperature. The increasing and decreasing rates of temperature in the furnace were 1° C./min or 6° C./min.

Example 4 XRD Analysis

X-ray diffraction (XRD) analyses were conducted to examine the coatings on the coupons. It was found that there were no shiftings of $BaZr_{0.3}Ce_{0.7}O_3$ peaks with $CeO_2$ percentage increasing in the coupons coated using slurries 1-4, which indicates that no significant reactions took place at the temperature of 1000° C. between $CeO_2$ and $BaZr_{0.3}Ce_{0.7}O_3$.

Regarding the coupon coated using slurry 5, $BaAl_2O_4$, $CeO_2$ and $BaZr_{0.3}Ce_{0.7}O_3$ were detected in the XRD analysis. It suggests that a reaction between $BaZr_{0.3}Ce_{0.7}O_3$ and Boehmite (20 wt % of $BaZr_{0.3}Ce_{0.7}O_3$) might have happened but a certain amount of $BaZr_{0.3}Ce_{0.7}O_3$ survived from the reaction.

With respect to the coupon coated using slurry 6, $BaZr_{0.3}Ce_{0.7}O_3$ and $CeO_2$ were detected in the XRD analysis of the coating.

As to the coupon coated using slurry 8, $BaZr_{0.3}Ce_{0.7}O_3$, $ZrO_2$, $BaZrO_3$, and $CeO_2$ were found in the XRD patterns of the coating, which suggests that some of $BaZr_{0.3}Ce_{0.7}O_3$ might have reacted with $ZrO_2$.

With respect to the coupon coated using slurry 10, $BaZr_{0.3}Ce_{0.7}O_3$, $BaZrO_3$, and $CeO_2$ were found in the XRD patterns of the coating, which suggests that some of $BaZr_{0.3}Ce_{0.7}O_3$ might have reacted with $ZrO_2$.

Speaking of the coupon coated using slurry 11, $BaZr_{0.3}Ce_{0.7}O_3$, $CeO_2$, $CeAlO_3$ were identified in the XRD patterns of the coating, which suggests that reactions might have happed among $BaZr_{0.3}Ce_{0.7}O_3$, boehmite and $CeO_2$.

With respect to the coupon coated using slurry 12, $BaZr_{0.3}Ce_{0.7}O_3$, $CeO_2$, and $Ba_2SiO_4$ were identified in the XRD patterns of the coating, which suggests that reactions might have happed between $SiO_2$ and some of $BaZr_{0.3}Ce_{0.7}O_3$.

Example 5 SEM Analysis

The coatings on the coupons were studied by scanning electron microscope (SEM) analysis. No obvious bindings between $BaZr_{0.3}Ce_{0.7}O_3$ powders were found in the coating of the coupon coated using slurry 1. For coupons coated using slurries 2-4, $BaZr_{0.3}Ce_{0.7}O_3$ powders were bonded better than in the coating of the coupon coated using slurry 1 and were better and better, with the increase of $CeO_2$, which indicates the coating strength gets higher with the addition and increasing of $CeO_2$. For coupons coated using slurries 5-12, $BaZr_{0.3}Ce_{0.7}O_3$ powders were also bonded better and formed coatings were more continuous than in the coating of the coupon coated using slurry 1, which indicates the coating strengths improved when inorganic materials were added.

Example 6 Tape Testing

Tape testing standard method, which is based on ASTM D3359, was employed to test the adherent strength of coatings on the coated coupon. For the coupon coated using slurry 1, most of the coating was pulled off from the coupon after the tape testing, which indicated its adhesion strength is poor. For coupons coated with slurries 2-4, with the increase of $CeO_2$ from 10 wt % to 50 wt % with respect to $BaZr_{0.3}Ce_{0.7}O_3$, damages of coatings due to the tape testing decreased. The coating adhesion strengths of coupons coated using slurries 1-4 were respectively 0 B, 1B, 3B and 5 B.

This tape testing result was well consistent with the coating surface morphology by SEM analysis in example 5. Both the tape testing and SEM analysis show that $CeO_2$ sol is an effective binder to significantly enhance the $BaZr_{0.3}Ce_{0.7}O_3$ coating strength.

Example 7 Thermal Shock Resistance Testing

To test the thermal shock resistance, coupons coated with slurries 1-12 were heated to 400° C. in an oven, and then be taken out to the room temperature quickly. No spall was found on any of the coatings of the coupons, which suggests that the coatings have good thermal shock resistivities.

Example 8 Inner Surface Coating

Some of slurry 5 prepared in example 2 was filled into a tube made from 310S alloy (outer diameter: 10 mm, thickness: 1 mm, and length: 150 mm) from one end of the tube with the other end thereof being sealed. The sealed end was opened to drain out the slurry by gravity 1 minute after the filling. The tube was kept vertical during the filling and draining. Compressed air (pressure=0.6 MP, flow rate=1 l/h) was injected into the tube to dry the wet slurry coating quickly. After drying by the compressed air, the tube was put into a furnace for sintering at 1000° C. for 3 hours in argon atmosphere before being cooled to the room temperature. The increasing and decreasing rates of temperature in the furnace were 6° C./min.

Example 9 Hydrocarbon Cracking

Coupons coated using slurries 1-6, 11 and 12 in example 3, a tube coated in example 8 and a 310S alloy tube without coating inside were placed on quartz sample holders at the constant temperature region of a lab scale hydrocarbon-cracking furnace. The furnace door was then closed. Argon gas was fed in the furnace at the flow rate of 100 standard cubic centimeters per minute (sccm). The cracking furnace was heated to 880° C. with the ramping rate of 20° C./min. A vaporizer was heated to 350° C. within 30 minutes.

When the temperature of the cracking furnace reached 880° C. and the temperature of the vaporizer reached 350° C., water was pumped using a piston pump into the vaporizer with the flow rate of 1.58 ml/min. Argon gas feeding was stopped. After 5 minutes, heptane was pumped using a piston pump into the vaporizer with the flow rate of 2.32 ml/min to be vaporized and mixed with the steam in the vaporizer in a 1:1 weight ratio. The temperature of the cracking furnace was maintained at desired temperature, e.g., 800+/−5° C. or 860+/−5° C. for desired time before stopping the pumpings of the heptane and water. The residence time of the heptane and steam in the cracking furnace was 1.5 seconds, unless otherwise specified. Argon gas was fed again at the flow rate of 100 sccm before the cracking furnace and the vaporizer were shut down. When the cracking furnace cooled down, argon gas feed was stopped and the furnace door was opened to take out the sample holders.

Coupons coated in example 3 using slurries 1-5 and 11-12 were tested for 5 hours at 850° C. No coke was observed on any of the coatings of the coupons but cokes were found on uncoated parts of all the coupons, which indicate the coatings are anticoking.

The coupon coated in example 3 using slurry 6 was tested for 160 hours at 850° C. No coke was found on the coated surface but cokes were found on uncoated parts of the coupon, which indicates that the coating was anticoking.

The tube coated in example 8 and the 310S alloy tube without coating inside were tested for 50 hours at 850° C. After anticoking testing, tubes were cut open. No coke was found on the inside coated surface of the coated tube while a 0.33 mm thick coke layer was found on the inner surface of the tube without coating, which indicates that the coated inner surface of the coated tube has an excellent anticoking performance.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method, comprising: providing a slurry comprising a perovskite material of formula $A_aB_bC_cD_dO_{3-\delta}$ and an inorganic material;

applying the slurry to a surface of a reactor; and sintering the slurry; wherein the inorganic material comprises at least one of cerium oxide, zinc oxide, tin oxide, zirconium oxide, boehmite and silicon dioxide;

$0<a<1.2$, $0\leq b\leq 1.2$, $0.9<a+b\leq 1.2$, $0<c<1.2$, $0\leq d\leq 1.2$, $0.9<c+d\leq 1.2$, $-0.5<\delta<0.5$;

A is selected from calcium (Ca), strontium (Sr), barium (Ba), and any combination thereof;

B is selected from lithium (Li), sodium (Na), potassium (K), rubidium (Rb), and any combination thereof;

C is selected from cerium (Ce), zirconium (Zr), antimony (Sb), praseodymium (Pr), titanium (Ti), chromium (Cr), manganese (Mn), ferrum (Fe), cobalt (Co), nickel (Ni), gallium (Ga), tin (Sn), terbium (Tb) and any combination thereof; and D is selected from lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu), scandium (Sc), titanium (Ti), vanadium (V), chromium (Cr), manganese (Mn), ferrum (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), gallium (Ga), indium (In), tin (Sn), antimony (Sb) and any combination thereof; said method further comprising heating an ethane containing feedstock in said reactor and in the presence of steam at a temperature of from about 480° C. to about 1,000° C. in order to form ethylene, said slurry inhibiting coke formation on said surface.

2. The method of claim 1, wherein the slurry further comprises at least one of an organic binder, a wetting agent and a solvent.

3. The method of claim 1, wherein a weight ratio of the inorganic material to the perovskite material is from about 0.1:99.9 to about 99.9:0.1.

4. The method of claim 1, wherein a weight ratio of the inorganic material to the perovskite material is from about 1:9 to about 9:1.

5. The method of claim 1, wherein a weight ratio of the inorganic material to the perovskite material is from about 1.5:100 to about 9:10.

6. The method of claim 1, wherein a total weight percentage of the inorganic materials and the perovskite material in the slurry is from about 10% to about 90%.

7. The method of claim 1, wherein a total weight percentage of the inorganic materials and the perovskite material in the slurry is from about 15% to about 70%.

8. The method of claim 1, wherein a total weight percentage of the inorganic materials and the perovskite material in the slurry is from about 30% to about 55%.

9. The method of claim 1, wherein the slurry is applied to the surface by at least one of sponging, painting, centrifuging, spraying, filling and draining, and dipping.

10. The method of claim 1, wherein the sintering is at about 1000° C.

11. The method of claim 1, wherein the slurry comprises $BaZr_{0.3}Ce_{0.7}O_3$.

12. The method of claim 11 wherein the inorganic material comprises cerium oxide.

13. A method, comprising:

providing a slurry comprising a perovskite material of formula $A_aB_bC_cD_dO_{3-\delta}$ and an inorganic material;

applying the slurry to a surface of a reactor; and sintering the slurry; wherein the inorganic material comprises at least one of cerium oxide, zinc oxide, tin oxide, zirconium oxide, boehmite and silicon dioxide;

$0<a<1.2$, $0\leq b\leq 1.2$, $0.9<a+b\leq 1.2$, $0<c<1.2$, $0\leq d\leq 1.2$, $0.9<c+d\leq 1.2$, $-0.5<\delta<0.5$;

A is selected from calcium (Ca), strontium (Sr), barium (Ba), and any combination thereof;

B is selected from lithium (Li), sodium (Na), potassium (K), rubidium (Rb), and any combination thereof;

C is selected from cerium (Ce), zirconium (Zr), antimony (Sb), praseodymium (Pr), titanium (Ti), chromium (Cr), manganese (Mn), ferrum (Fe), cobalt (Co), nickel (Ni), gallium (Ga), tin (Sn), terbium (Tb) and any combination thereof; and D is selected from lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu), scandium (Sc), titanium (Ti), vanadium (V), chromium (Cr), manganese (Mn), ferrum (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re)C, osmium (Os), iridium (Ir), platinum (Pt), gold (Au), gallium (Ga), indium (In), tin (Sn), antimony (Sb) and any combination thereof;

the slurry comprising a member selected from the group consisting of:

(i) $BaZr_{0.3}Ce_{0.7}O_3$, cerium oxide, glyceral, polyvinyl alcohol, and water;

(ii) $BaZr_{0.3}Ce_{0.7}O_3$, boehmite, glycerol, polyvinyl alcohol, polyethylene glycol octylphenol ether and water;

(iii) $BaZr_{0.3}Ce_{0.7}O_3$, zinc oxide, glycerol and polyvinyl alcohol;

(iv) $BaZr_{0.3}Ce_{0.7}O_3$, zirconium oxide, glycerol and polyvinyl alcohol;

(v) $BaZr_{0.3}Ce_{0.7}O_3$, zirconium oxide, cerium oxide, glycerol and polyvinyl alcohol;

(vi) $BaZr_{0.3}Ce_{0.7}O_3$, boehmite, cerium oxide, glycerol and polyvinyl alcohol;

(vii) $BaZr_{0.3}Ce_{0.7}O_3$, silicon dioxide, glycerol and polyvinyl alcohol.

14. The method of claim 13 wherein the slurry is (i).

15. The method of claim 13 wherein the slurry (ii).

16. The method of claim 13 wherein the slurry is (iii).

17. The method of claim 13 wherein the slurry is (iv).

18. The method of claim 13 wherein the slurry is (v).

19. The method of claim 13 wherein the slurry is (vi).

20. The method of claim 13 wherein the slurry is (vii).

* * * * *